US005556352A

United States Patent [19]

Chang

[11] Patent Number: 5,556,352

[45] Date of Patent: Sep. 17, 1996

[54] STAIR EXERCISER

[76] Inventor: Shao-Ying Chang, No. 764, Chung Shan South Road, Yang Mei, Taoyuan, Taiwan

[21] Appl. No.: 442,777

[22] Filed: May 17, 1995

[51] Int. Cl.[6] ..... A63B 22/04

[52] U.S. Cl. ..... 482/52; 482/51

[58] Field of Search ..... 482/51, 52, 53, 482/54, 111, 37, 42, 908, 903

[56] References Cited

U.S. PATENT DOCUMENTS

| | | | |
|---|---|---|---|
| 3,497,215 | 2/1970 | Harrison et al. | 272/69 |
| 3,592,466 | 7/1971 | Parsons | 272/69 |
| 4,687,195 | 8/1987 | Potts . | |
| 4,726,581 | 2/1988 | Chang . | |
| 5,145,475 | 9/1992 | Cares | 482/52 |
| 5,195,935 | 3/1993 | Fencel | 482/52 |
| 5,328,420 | 7/1994 | Allen | 482/52 |
| 5,328,422 | 7/1994 | Nichols | 482/52 |

*Primary Examiner*—Stephen R. Crow
*Attorney, Agent, or Firm*—Burns, Doane, Swecker & Mathis, LLP

[57] ABSTRACT

A stair exerciser having a plurality of revolvable steps supported by endless chain conveyors and a control device for speed control, which, by the weight and action of a user walking on the steps, enables the mechanism to run cyclical and continuous action thereby affording the user stair climbing like exercises.

5 Claims, 7 Drawing Sheets

14
1C
10
19
46
41
3
47
10
51
4
5
45
1A
12
3
35
13
25
34
21
44
33
23
42
3
43
1
33
1B
13
11
7
15
2
24
1D
22
16
17

STAIR EXERCISER

BACKGROUND OF THE INVENTION

1. Field of the Invention

The present invention relates to a stair exerciser and, more particularly, to an indoor cyclic stair exerciser having a plurality of revolvable steps supported by endless chain conveyors and a control device for speed control and arranged like an escalator, and which, by the weight and action of a user walking on the steps, enables the mechanism to run cyclical and continuous actions thereby affording the user stair climbing like exercises.

2. Prior Art

Many kinds of stair exercisers or treadmill exercisers are known, among these may be cited, for instance, the U.S. Pat. No. 3,497,215 to Harrison, et al, which discloses a stair exerciser consisting of stairs supported by endless chain conveyors and a hydraulic control system for control of the speed. Parsons' U.S. Pat. No. 3,592,466, like Harrison et al patent, teaches a stair exerciser consisting additionally of a device for adjusting the slope of the treadmill. The U.S. Pat. No. 4,687,195 to Potts, like Parsons' patent, discloses a treadmill exerciser having a mechanical speed control system and also the steps comprised of riser portion and tread portion are connected by hinges to each other to be at three points, that is, the chain side connecting ends of each of the riser portion and the tread portion and the connecting end of the riser portion and the tread portion are pivotable or foldable. The upper end of the riser portion of each step is connected by the afore-said hinges to the rear end of the tread portion of the same step while the lower end of the riser portion is connected by a hinge to the front end of the tread portion of the succeeding step. Next, in the U.S. Pat. No. 4,726,581, Chang discloses a stair exerciser similar to the one disclosed in Parsons' patent, but has cantilever-mounted steps.

In the steps used by Harrison and Parsons, the riser portion and the tread portion are formed that they are not foldable with respect to each other and this is thus disadvantageous to the drive of the chains. Although in Potts patent, the steps are mutually pivotable and foldable, owing to the use of three units of transversely long extended hinges to connect and fix each of the step members the construction is very complicated and the assembly is also inconvenient. Besides, the speed control system in Potts' treadmill exerciser is rather complicated and also requires hand manipulation and control. On the other hand, in Chang's patent because the steps are of a cantilever fashion the stability of support is not satisfactory.

SUMMARY OF THE INVENTION

Accordingly, an object of the present invention is to provide a stair exerciser for a user to walk up the steps of a sloping stair construction and by the weight of the person to make the steps run cyclically and also by the use of a speed controller to control and adjust the speed and resistance force in order to suit the physical condition of each person.

A further object of the present invention is to provide a stair exerciser, the steps of which are supported on each side by a pair of mutually pivotably interconnected inverted L-shaped links to form a more stable and simple construction, the two ends of the afore-said L-shaped links being pivotably connected to cross shafts equi-spaced and supported transversely in parallel with each other on a pair of chains and being pivotable relative to the shafts, each of the set of the L-shaped links not being connected to each other and sharing a cross shaft.

A still further object of the present invention is to provide a stair exerciser, the speed controller of which uses a electromagnetic speed controller and is capable of adjusting the running speed of the steps by the change of strength in the electromagnetic field and, if by any chance there is a run over in speed or a power failure, is capable of an automatic brake to stop moving of the steps thereby preventing the user from slipping below the steps.

Another object of the present invention is to provide a stair exerciser having a stable, stout and transportable structural frame body.

BRIEF DESCRIPTION OF THE DRAWINGS

Other aspects and advantages of the present invention will become apparent from the following description of the preferred embodiment, taken in conjunction with the accompanying drawings wherein.

DETAILED DESCRIPTION OF THE PREFERRED EMBODIMENT

Figure 1:
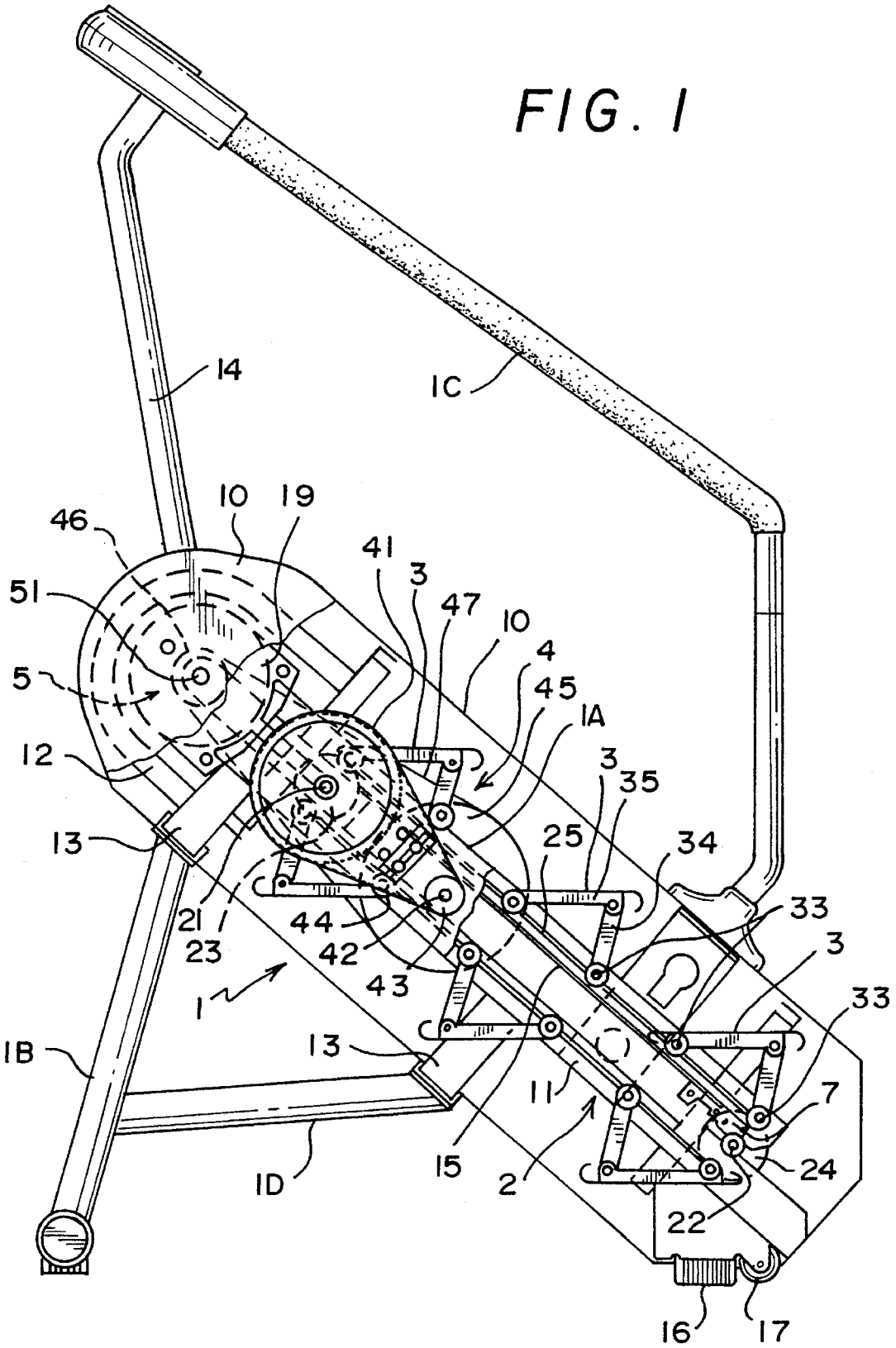
FIG. 1 is a partial sectional left side view of the stair exerciser according to the present invention.
Figure 2:
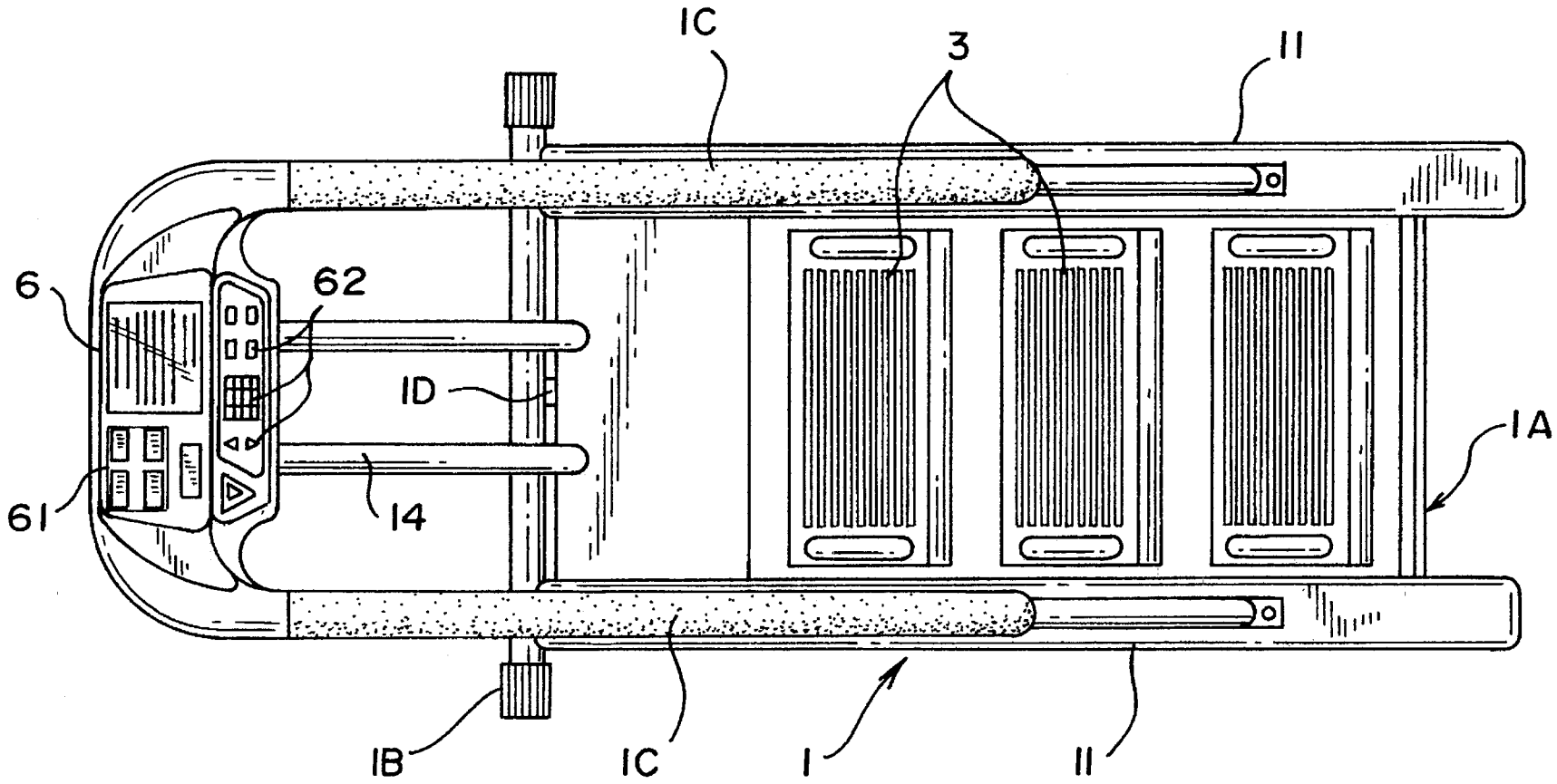
FIG. 2 is a top view of the stair exerciser of FIG. 1.
Figure 3:
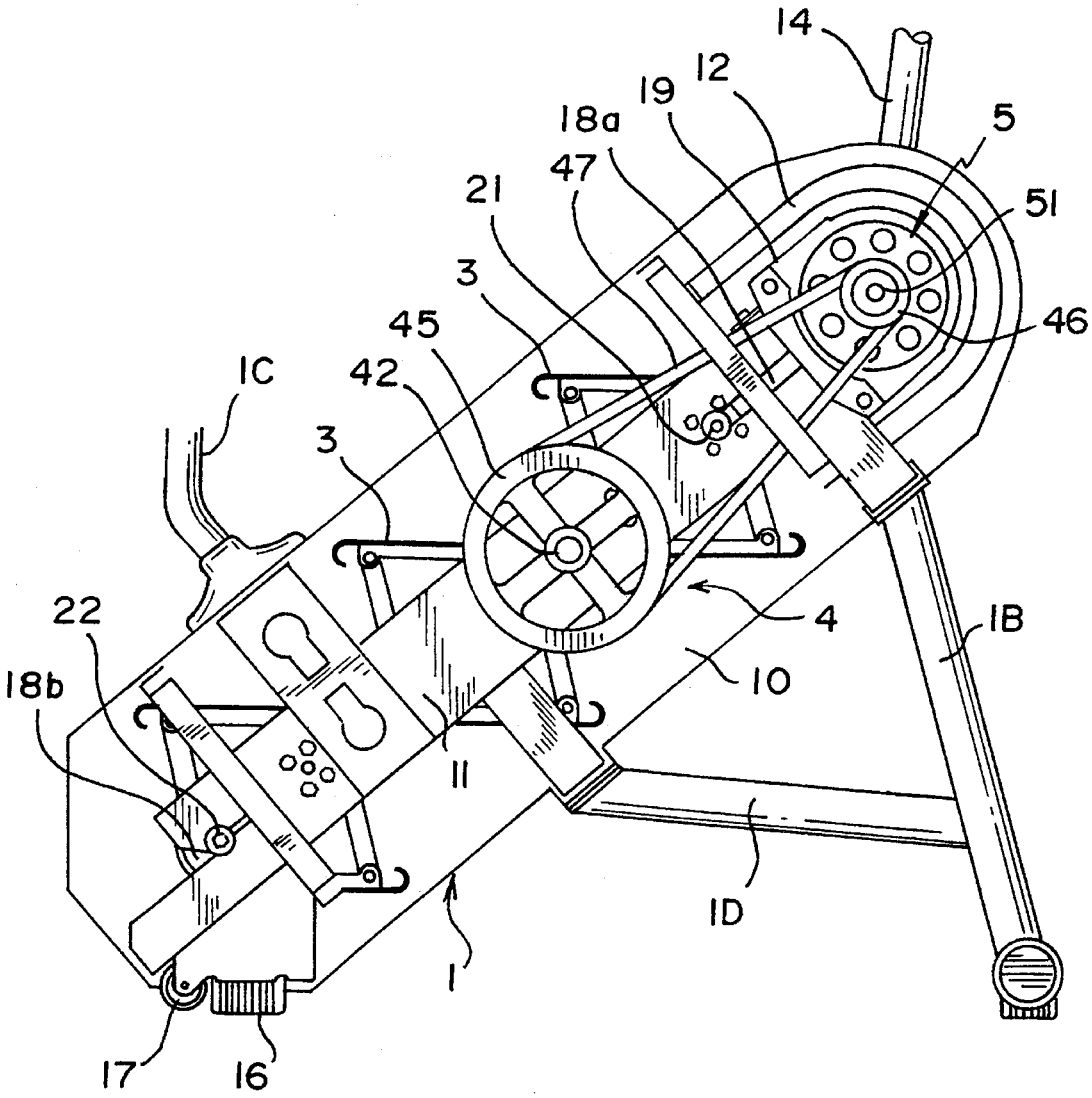
FIG. 3 is a partial sectional right side view of the stair exerciser of FIG. 1.

Referring to the drawings, in particular, FIG. 1 to 2, there is shown a stair exerciser of the present invention. The exerciser in its entirety is formed like a moving stairway, comprising a structural frame 1, a pair of chain sprocket assemblies 2 synchronously revolvably inclinedly disposed in a cyclical manner on the two sides of the structural frame 1, a plurality of steps 3 disposed transversely across the pair of chain sprocket assemblies 2, a transmission device 4 for transmitting to speed controller the driving torque of the chain sprocket assemblies 2, a speed controller 5 for the control of revolution speed of the chain sprocket assemblies 2 and a control panel 6 disposed on the front upper portion of the frame 1 for adjusting the setting of running condition in the speed controller 5 and for being able to show the use condition of the machine.

Figure 4:
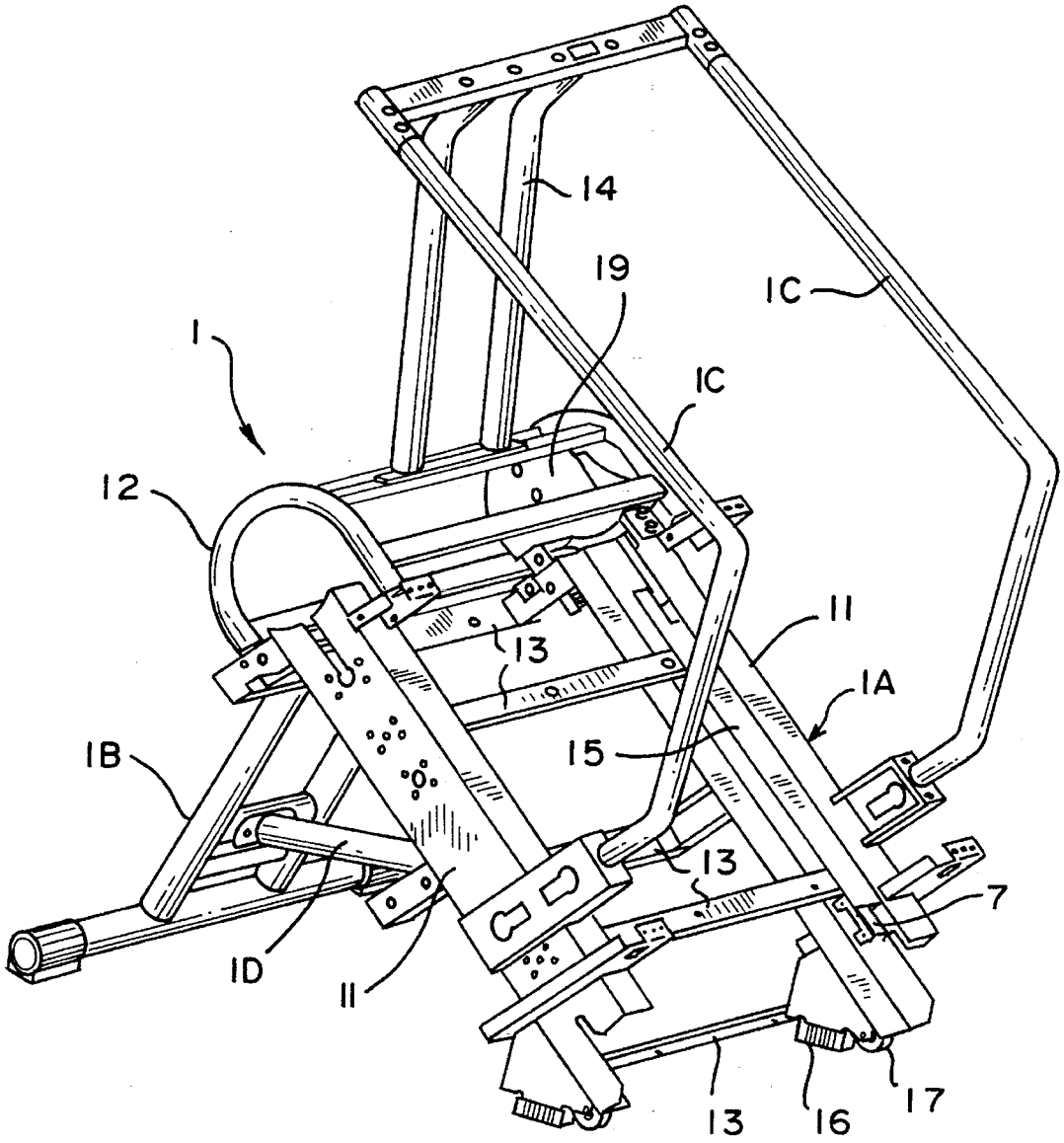
FIG. 4 is a perspective view of the structural frame body of the stair exerciser of FIG. 1.

The structural frame 1 is formed of steel pipe and steel plates in a structural body having a main body portion of the lower half part appearing to be slightly A-shaped in lateral view and inclined tubular shaped hand rails extending upwardly from the portion. A detailed construction of this frame 1 is especially shown in FIG. 4 where it comprises a stair frame 1A formed like a stair by a pair of symmetrically inclinedly arranged side brackets 11 having at the front end a semicircular tubular head 12 and connected by a plurality of transverse connecting members 13, an inverted π-shaped tubular front support foot 1B mounted on the front lower end of the stair frame 1A to support the stair frame 1A to be in the inclined position, a pair of tubular hand rails 1C extending upwardly vertically and next extending towards the front upper portion respectively from close the lower part of the left and right side brackets and connected and supported at the front end by a π-shaped support members 14, and a central connecting rod 1D for connecting the lower center of the front support foot 1B to the stair frame 1A at the lower part.

The left and right side brackets 11 are formed basically in the channel-section iron shape and are arranged spaced apart with rabbet portions opposing each other. Each of the side brackets 11 is provided on the channel bottom, that is, the inner wall, slightly above with an inclined guide plate 15 forming the downward guide rail, the two plates opposing each other. The side bracket 11 is also provided on the lower end with a rubber made back leg 16 and a rear castor 17 of a slightly higher position. When the front part of the entire stair frame 1 is lifted up the rear castors 17 touch on the ground and in this way the stair exerciser can be pushed to move.

The chain sprocket assemblies 2 are mounted between the two side brackets and comprise: an upper chain sprocket shaft 21 passing through an upper channel opening 18*a* of the side sprockets 11 at both ends thereof to be rotatably transversely supported on the bottom end of the channel opening by a bearing, a lower chain sprocket shaft 22 passing through a lower channel opening 18*b* of the side sprocket 11 at both ends thereof to be rotatably transversely supported on the bottom end of the channel opening by a bearing and being parallel with the upper chain sprocket shaft 21, a pair of upper chain sprockets 23 fixed to the two end portions of the upper chain sprocket shaft 21 to be located on the inner side of the two side brackets 11, a pair of lower chain sprockets 24 fixed to the two end portions of the lower chain sprocket shaft 22 to be located on the inner side of the two side brackets 11 and being corresponding to the upper chain sprockets 23, and a pair of endless chains 25 wound around between the upper and lower chain sprockets 23, 24 to be able to perform synchronous movement. The chain sprocket assemblies 2 are thus formed in an inclined chain conveyor.

Figure 6:
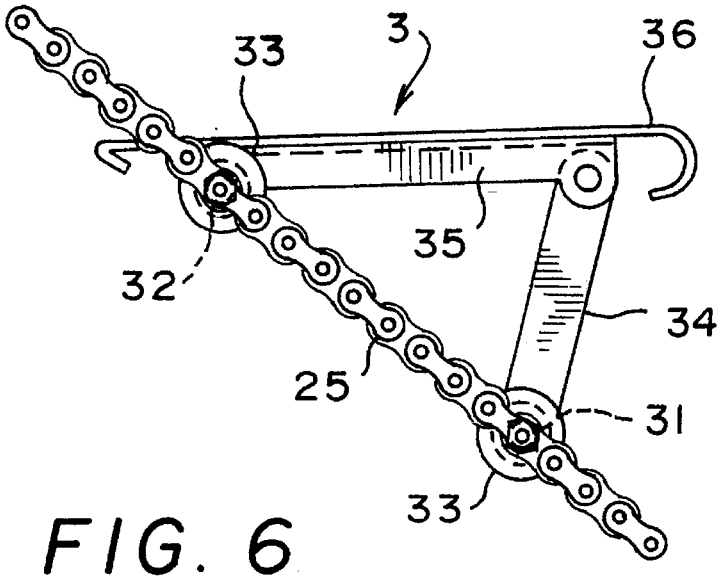
FIG. 6 is an enlarged side view of a step and the associated drive chain portion.
Figure 7:
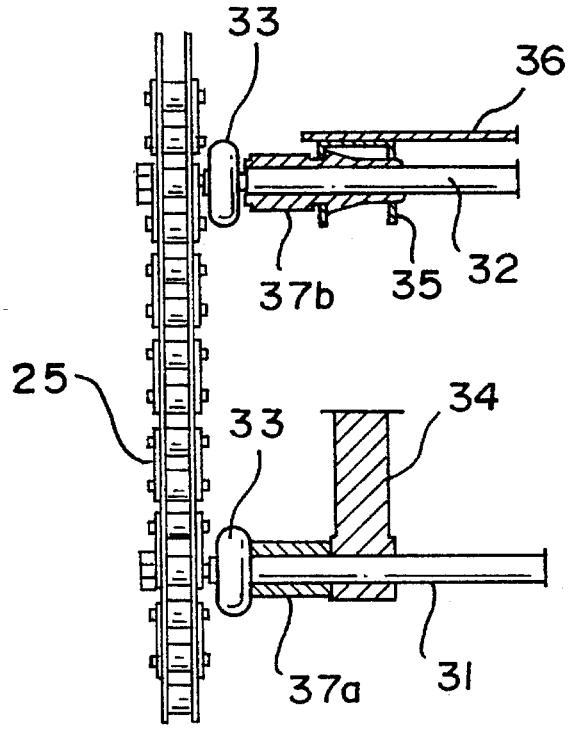
FIG. 7 is an enlarged partial sectional front view of the step and the drive chain portion of FIG. 6.

As shown in FIG. 1, the sets of steps 3 are kept apart in equi-spaces and the left and right sets of links are pivotably disposed along the entire length of the two chains 25. A detailed construction of this set of steps 3, as shown in FIGS. 6 and 7, includes two parallel transverse long shafts 31, 32 maintained at a predetermined space from each other and secured to the two left and right chains 25 by the two ends, four rollers 33 rotatably mounted on each end of the two long shafts 31, 32 at close to the inner side of the chain 25, a pair of vertical links 34 having the base end pivotably mounted on the two ends of the long shaft 31 between the two rollers 33 of the same shaft and the other end extending upwardly, a pair of channel horizontal links 35 having the base end pivotably mounted on the two ends of the long shafts 32 between the two rollers 33 of the same shaft and the other end extending horizontally towards the rear part of the apparatus, a tread 36 having the two ends fixed by appropriate fixing means, for instance, screws, like an overbridge to the two horizontal links 35, and spacers 37*a*, 37*b* mounted respectively on the above of the long shafts 31 and 32 between the roller 33 and the link 34 and the roller 33 and the link 35 and whereas the vertical link 34 and the horizontal link 35 are pivotably connected by a pin 38 to form a foldable inverted-V shaped linkage.

The transmission device 4 is mounted on the upper part of the stair frame 1A and comprises a large belt pulley 41 fitted to one end of the upper chain sprocket shaft 21 protruding out from one side bracket 11 of the stair frame 1A, a driven shaft A2 rotatably mounted on the center at a slightly upper location of the stair frame 1A and being parallel with the upper chain sprocket shaft 21, a small driven belt pulley 43 fitted to one end of the driven shaft 42 protruding out from the side bracket 11 to be corresponding with the drive belt pulley 41, a drive belt 44 suspendedly located between the drive and driven belt pulleys 41, 43, a large belt pulley 45 fitted to one end of the driven shaft 42 protruding out from the other side bracket 11, an output side small belt pulley 46 fitted to one end of the main shaft 51 of the speed controller 5 to be described hereinbelow and corresponding to the belt pulley 45, and a drive belt 47 suspendedly located between the large and small belt pulleys 45, 46. When a user treads on the steps 3 and by weight of the user to move the chain 25 to rotate synchronously like a conveyer, the rotating torque is transmitted through the upper chain sprocket 23 and the upper chain sprocket shaft 21 to the drive belt pulley 41 of the transmission device 4. This belt pulley 41, next through the drive of a drive system of the belt 44, the driven belt pulley 43, the driven shaft 42, the belt pulley 45, the belt 47 and the belt pulley 46, on one hand, increases in speed and, on the other hand, transmits the rotating output torque to the main shaft 51 of the speed controller 5.

In the present embodiment, in order that the power transmission be precise and to avoid slip, the belt pulleys 41, 43, 45, 46 and the belts 44, 47 use timing belt pulleys and belts; however, it is also possible, for substitution, to a change of use of a chain and sprocket assembly or a V-shaped belt pulley and V belt assembly. Again, for adjustment of tension in the belt 44 a tension-adjusting gear 48 is located between the two belt pulleys 41, 43 on the above of the side brackets 11.

Figure 5:
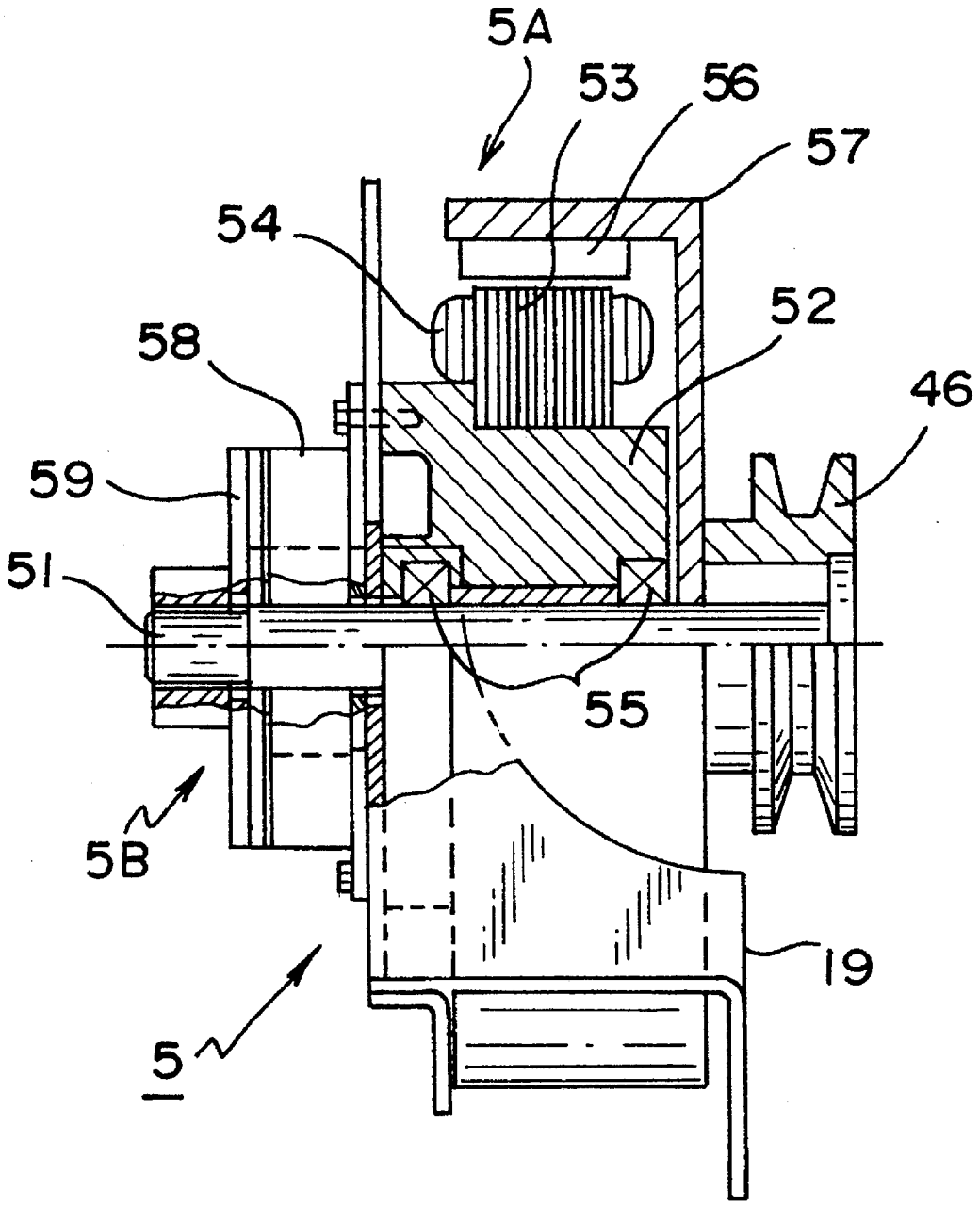
FIG. 5 is a schematic view of the essential part of the electromagnetic speed controller.

The speed controller 5 is located between the head portion 12 and a bracket 19 on one side of the stair frame 1A and, as shown in FIG. 5, comprises a stator 52 fixed to the bracket 19 and provided on the outer circumference thereof with a core 53 and a coil 4, a main shaft 51 rotatably passing through and supported in a central hole of the stator 52, a rotor 57 fixed to the main shaft 51 and surrounding on the outer circumference of the stator 52 and provided on the inner circumferential wall thereof with several magnets 56, an electromagnetic brake drum 58 fixed to the lateral side of the stator 52 and with which it is integrally formed and a pair of electromagnetic brake discs 59 with which the brake drum 58 is able to move axially and rotatably mounted on the main shaft 51. The above-mentioned main shaft 51, stator 52 and rotor 57 together constitute a motor 5A to generate an electric current and to supply for use by electromagnetic brake means 5B formed by the brake drum 58 and the brake discs 59.

The control panel 6 is located on the front part of the hand rails 1C of the frame 1 and the upper part of the supporting member 14, and includes a microprocessor (not shown), a touch control button or key 61, a display and a related circuit (not shown). This control panel is for use by following the conditions of use desired by the user in the control and adjustment of speed in the steps through the speed controller 5.

Figure 8:
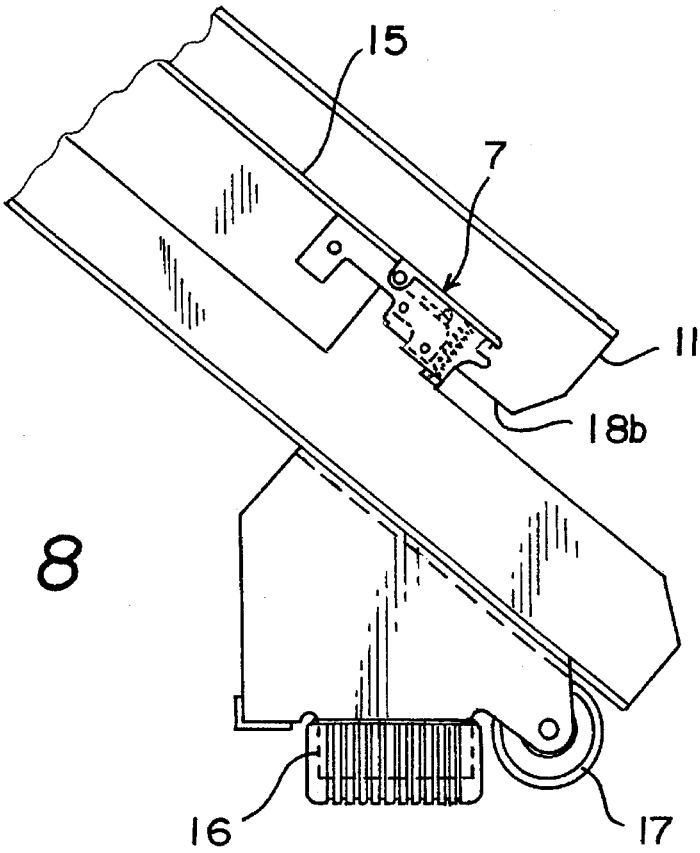
FIG. 8 is a schematic view of a safety switch device disposed on the lower end of the guide track channel.
Figure 9:
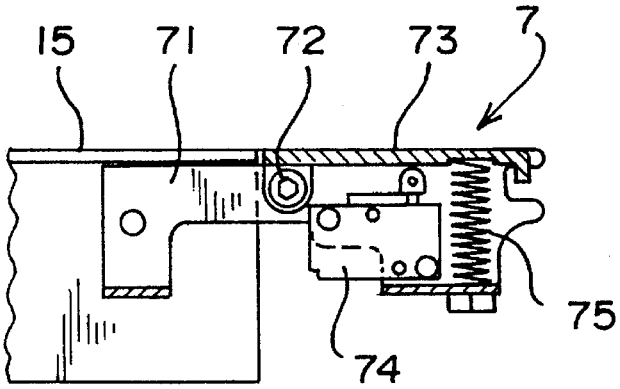
FIG. 9 is a detailed construction view of the safety switch device of FIG. 8.

In order to protect the exposed transmission device 4 and other members and to prevent any accidental risk that might lead to injury to one's body, on the outer side of the stair frame 1A there is provided at the lower end of the guide rail 15 on one side of the frame a safety switch device 7. This safety switch 7, as shown in FIGS. 8 and 9, comprises a fixing plate 71 attached to the side bracket 11 beneath the lower end of the guide rail 15, an actuating arm 73 swingably pivoted to the middle part of the fixing plate 71 and having the upper surface being flush with the upper surface of the guide rail 15, a microswitch 74 located on the fixing plate 71 beneath the actuating arm 73 and a spring 75 disposed beneath the actuating arm 73 for supporting the free end of the arm 73. This Spring 75 in the free state has a spring force capable of bearing a load of the rollers 33 that slide to the place together with a set of the steps 3 borne by the rollers when there is no person carried by. Also, the microswitch 74 usually is kept in a state where it is in touch with the actuating arm 73 but not connecting. Therefore, when the exerciser operates normally, this microswitch 73 is maintained in the normal open state. Once when operation is abnormal or the speed runs too fast and the step 3 has slid to the lower-most end of the guide rail 15 while foot of the user is still on the step, unabling to bear the load that has been added to the set of steps 3 of the rollers 33 and the addition of partial weight of the person's body, the spring 75 retracts. As a result, the actuating arm 73 with the pin 72 as the centre swings downwardly and presses the microswitch 74 so that the switch 74 is connected and via the circuit to urge the electromagnetic brake means 5B to brake, whereby the entire exerciser is stopped to operate. In this way it is possible to prevent accident from happening.

In the following, the exerciser of the present invention will be described with relation to its operation and use.

In use of the exerciser, the user may first set the conditions of use through the touch key 61 and display 62 on the control disc 6 in accordance with one's body weight and/or the desired speed, or the user may step on the steps 3 directly with two feet alternating with each other like climbing a stair. Due to body weight of the user, the steps 3 start to slide downwardly through the drive of the chain sprocket assembly 2 and drive the upper chain sprocket shaft 21. This chain sprocket shaft 21 as a consequence transmits via the belt pulley 41, belt 44, belt pulley 43, driven shaft 42, belt pulley 45, belt 47 and the belt pulley 46 the rotational force to the motor 5A of the electromagnetic speed controller 5. The rotational force is thereby used to generate an appropriate magnetoelectric strength for controlling the brake means 58 in order to achieve the set speed. The speed can also be adjusted until it reaches the desired level by means of the control panel 6 if this speed runs too fast or too slow. During use, when speed runs too fast and the foot has not moved in time onto the step of the upper one, the safety switch 7 will act to make the brake means 5B to brake-stop totally. The exerciser stops in movement, whereby it can prevent the user from falling down by a slip and any accident from happening. When it is re-initiated, the exerciser can return to operate again.

Because of a configuration as above, the present invention is able to provide a stair like exerciser the entire structure of which is sturdy, compact and safe, not likely to run trouble and being movable.

The specific example of the present invention as shown and described herein is for illustrative purposes only. Various changes in structure will no doubt occur to those skilled in the art, and will be understood as forming a part of the present invention insofar as they fall within the spirit and scope of the appended claims.

I claim:

1. A stair exerciser performing cyclical action in continuity by the body weight and action of the person who steps on the stairs thereof and controlling the operating speed and the resistance by means of a speed controller, comprising:

a structural frame constituting a staircase having hand rails, a pair of chain sprocket assemblies synchronously revolvably inclinedly disposed in a cyclical manner on the inner side of the two side brackets of the structural frame to constitute a chain conveyor, plurality of steps disposed across the chain sprocket assemblies and capable of moving cyclically following the revolving chain sprocket assemblies, a transmission device disposed on the outer side of the two side brackets of the structural frame for transmission to the speed controller of the driving torque produced by the chain sprocket assemblies, an electro-magnetic brake to adjust and control the downwardly running speed of the steps driven by the chain sprocket assemblies, and a control panel disposed on the front upper portion of the structural frame for adjusting the setting of start and stop of the machine and the steps running speed controlled via the speed controller;

wherein the steps are span between the two chains and are equi-spaced along the outer side of the two chains and include two spaced-apart parallel transverse shafts with two ends fixed on the two chains, two pairs of rollers rotatably pivoted to the respective ends of the two shafts, a pair of rising links having the root end pivotably connected to the two ends of the lower shaft on the inner side of the two rollers and the other end extending upwardly, a pair of channel type horizontal links having the root end rotatably connected to the two ends of the upper shaft corresponding in position to the rising links and the other end extending horizontally outwardly, two pins for pivotably connecting other free ends with each other of a pair of the rising and horizontal links, and a step plate spanning on a pair of the horizontal links, wherein a space is maintained between the pivoted root end at the shaft side of each of the rising links and the pivoted root end at the other shaft side of the horizontal link therebeneath and there is provided a spacer between each roller and the pivoted root end of each link.

2. The stair exerciser according to claim 1, wherein the structural frame includes a stair frame formed by a pair of channel-shape side brackets disposed in a spaced symmetrical and inclined manner and having at the front end a semi-circular tubular head portion and a plurality of transverse connecting members, an inverted π-shaped tubular front support foot mounted in the front lower end of the stair frame for supporting the stair frame to be in an inclined manner having a raised front portion and a lowered rear portion, a pair of tubular hand rails extending upward and forward from the rear part of the two side brackets and having the front end connected by a π-shaped support member to the support, a tubular central connecting rod for connecting the front support foot to the stair frame and a rear support foot mounted in the rear lower end of the stair frame and having on the rear portion thereof a caster.

3. The stair exerciser according to claim 1 or 2, wherein the speed controller includes a stator fixed on the bracket in the upper portion of the stair frame and provided on the outer circumference with core and coil, a main shaft passing through a central hole in the stator and rotatably supported in the hole by bearings, a rotor fixed on the main shaft to surround the outer circumference of the stator and provided on the inner circumferential wall thereof with a plurality of magnets, and electro-magnetic brake drum fixed on one lateral side of the stator and an electro-magnetic brake disc being axially movable in relation to the brake drum and rotatably mounted on the main shaft.

4. The stair exerciser according to claim 1, wherein the transmission devices include a drive belt pulley located on one end of the upper sprocket shaft that projects out of the side brackets, a smaller driven belt pulley mounted on the driven shaft which is located at the slightly lower part of the upper sprocket shaft and corresponding to the drive belt pulley, a drive belt wound between the drive belt pulleys, a large belt pulley mounted on one end of the driven shaft that projects out of the other side bracket, a small belt pulley mounted on one end of the main shaft of the speed controller which is located on the upper part of the stair frame, and a drive belt wound between the large and small belt pulleys.

5. The stair exerciser according to claim 1, wherein the guide track on one side bracket of the structural frame is provided for downward sliding by the rollers and on the lower end of the guide track is mounted a safety switch device, this safety switch device comprising: a fixed plate disposed on the side bracket beneath the lower end of the guide tracks, an actuating arm swingingly pivoted to the middle portion of the fixed plate by a pin and having the upper surface flush with the upper surface of the guide plate, a microswitch mounted on the fixed plate beneath the actuating arm and a spring disposed beneath the actuating arm for supporting the free end of the actuating arm, said spring being set of a loaded spring force which, in the free condition, is capable of bearing the rollers sliding thereto together with one set of steps it bears when there is no person carried on, while the microswitch normally maintains in a condition where it is in touch with the actuating arm but is not closed, thus when the exerciser is in the normal operation, the microswitch maintains in the normal open condition and when operation is abnormal or the speed is too fast so that before the user has moved one leg from the step and the steps have moved to the most lower end of the guide track, owing to the spring which is unable to bear the load of the steps plus partial weight of the human body on the rollers, it becomes retracted, and as a result, actuating arm with the pin as the center swings downwardly and presses the microswitch such that the switch is on and via the circuit energizes the electro-magnetic brake means to brake the exerciser to stop operating entirely.

* * * * *